US006244008B1

(12) United States Patent
Miller

(10) Patent No.: US 6,244,008 B1
(45) Date of Patent: Jun. 12, 2001

(54) LIGHTWEIGHT FLOOR PANEL

(76) Inventor: John Fullarton Miller, 47-169 B Hill Akepa R, Kaneohe, HI (US) 96744

( * ) Notice: Subject to any disclaimer, the term of this patent is extended or adjusted under 35 U.S.C. 154(b) by 0 days.

(21) Appl. No.: 09/352,673

(22) Filed: Jul. 10, 1999

(51) Int. Cl.[7] ..... E04C 2/00

(52) U.S. Cl. ..... 52/602; 52/79.9; 52/309.12; 52/794.1

(58) Field of Search ..... 52/79.1, 79.9, 52/79.14, 601, 602, 405.1, 405.2, 405.3, 309.12, 309.17, 782.1, 794.1

(56) References Cited

U.S. PATENT DOCUMENTS 4,942,707 * 7/1990 Huettemann ..... 52/309.12 X
5,440,845 * 8/1995 Tadros et al. ..... 52/309.12
5,697,189 * 12/1997 Miller et al. ..... 52/79.9
5,953,864 * 9/1999 Beck .
6,000,194 * 12/1999 Nakamura ..... 52/794.1 X
6,061,993 * 5/2000 Bendixen et al. .
6,085,485 * 7/2000 Murdock ..... 52/794.1 X

* cited by examiner

*Primary Examiner*—Robert W. Gibson, Jr.

(57) ABSTRACT

A specific type of preassembled lightweight floor panel comprising, a subassembly of steel trusses separated by panels of insulation panels, with the edges of the insulation panels beveled in such a manner as to expose the top and bottom chords of the trusses, the first cementitious layer cast on the lower face by forcably immersing this subassembly in a thin layer of cementitious fluid until the bottom chord of the steel trusses is encased, then after the floor panels and all of the surrounding structural elements are instaled, a second layer cementitious cast over these floor panels providing these panels with a finished floor surface and permanently attaching this floor panel to the walls above and below the floor these specific floor panels are used above grade on dwarf walls, piers, on floors over basements, on floors between upper levels and on flat roofs.

11 Claims, 5 Drawing Sheets

LIGHTWEIGHT FLOOR PANEL

FIELD OF INVENTION

This invention relates to a lightweight steel reinforced cementitious floor panel and the manner in which self-levelling cement is used on site as a structural element to complete this floor and as a means to interconnect this floor to the surrounding structure

BACKGROUND OF THE INVENTION

Conventional framed house floor construction consists of an upper decking membrane supported on a structural framework. A floor membrane typically consists of one or more layers of plywood, lumber or other sheeting material securely attached to the framing. The commonly used design load for residential floors is forty (40) pounds per square foot (40 PSF).

Floor framing consists of equally spaced parallel floor joists supported by a limited number of transverse supports such as beams, piers and walls. There are many types of floor joists, including solid lumber, light gauge steel "C" shaped channels and various types of manufactured floor joists. The weight of this type of floor ranges between 8 and 20 PSF for a design load of 40 PSF.

Insulation is included between the floor joists if any face of this floor is exposed to the elements. Sheathing such as drywall is added to the underside of the floor if it is exposed to living or storage area below this floor.

Assembling a framed floor on site is relatively slow, primarily because of the large numbers of components and fasteners needed. To ensure that the entire structure above and below the floor is able to withstand forces of wind or earthquake, all components must be securely attached to each other and suitably anchored to the surrounding structure. To laterally stabilize the floor joists, lateral bracing or blocking is commonly used between these floor joists. Lumber, in its many forms, is usually the least expensive flooring material, but subject to fire and termites.

Concrete is another commonly used element but a very heavy flooring medium. There are three types of concrete floor slabs, namely, slab on grade, suspended slabs and precast floor panels.

Slab on grade consists of preparing a level site, adding and compacting a suitable base coarse, excavating for concrete beams to be cast in the floor with the floor slab, providing perimeter forms to retain the fluid concrete, and installing the plumbing and electrical components to be cast in, through or under the floor, adding suitable reinforcing steel bars then pouring the concrete slab, taking care to ensure the finished floor is both level and smooth. This type of floor uses an excessive quantity of concrete. Subsequently changes and alterations are difficult. The weight of concrete for this type of floor with the base coarse and concrete beams under the slab is 90 to 100 PSF.

Suspended slabs are commonly used on multi-level and multi-family housing. The primary advantage of concrete is that it provides a suitable fire resistant barrier between floors. This on-site casting process involves building a temporary supporting form to retain this heavy concrete in its fluid state and then removing this temporary supporting form seven to fourteen days later, when this steel reinforced concrete floor has developed sufficient strength to be self supporting. The finished weight of this type of floor ranges between 50 and 150 pounds per square foot. This type of floor is slow to erect and expensive. Excessive time and labor is used to erect and dismantle temporary forming components.

Several types of precast concrete flooring systems have been developed to avoid this slow on site labor intensive process of assembling and dismantling a temporary mold to cast concrete on site.

One such precast floor panel is a concrete hollow core planks usually 48" or 24" wide, reinforced with steel tendons. The mechanical manufacturing process includes casting longitudinal voids in these panels to reduce the weight of these heavy concrete panels by a mere 20–25%. This type of floor requires an additional concrete topping material of at least 1" thick in order to obtain a level floor surface and interlock the panels together. The finished weight of this type of floor ranges between 70 and 100 PSF. The width of this particular type of precast floor panel is limited to 24" or 48" because of the excessive weight of a panel and the size and cost of the erection equipment. These narrow precast planks speed up construction considerably but still require site welding between the panels and the addition of connector bars between the planks and the wall structure and a layer of cementitious material is used to complete the floor or provide a level surface.

Another type of precast floor panel consists of casting only the lower half of the floor panel in widths up to 96". The initial manufacturing weight of this type of precast floor is approximately 30 PSF. This incomplete precast panel is assembled on site and then used to support the casting of the upper half of this floor. The finished weight of this type of floor ranges between 60 and 90 PSF. This precast method eliminates still more of the on-site work, but still results in a heavy floor.

All of these types of concrete floors rely on the use of steel bars cast in one element, projecting into or through or welded to the next element, and all of these suspended concrete floors do not include insulation.

Self leveling cements have been specifically developed to fill any depressions left in the initial concrete pour. Self leveling cements are also used on framed floor construction to eliminate floor joints, squeaking plywood floors as well as providing a suitable level surface for ceramic and vinyl floor tiling.

The primary considerations in designing floors of constant thickness are, one (1) the designated floor load, two (2) the length of the unsupported span and three (3) the maximum allowable deflection of the floor. The greater the span or load, the greater the depth of the floor. The maximum stresses or forces usually occur at mid-span and consist of tension force on the underside of the floor and compressive forces on the top side of the floor. These stresses are reversed at the points of support.

In concrete floor design, the ideal lower tension members are preferably steel and the ideal upper compression member is concrete. In each of the above types of concrete floors the concrete upper skin provides the necessary surfacing to the entire floor, however the remaining 80% or more of concrete below this skin does not contribute to the strength of the floor, and in fact adds unnecessary weight and cost to the floor. The steel in tension near the lower face of the floor occupies a very small area and needs only to be locally encased ½ of cementitious material as surface protection or fire protection. Another design consideration is the manner and sequence in which the structural elements of the floor are integrated with the surrounding structure. Still other considerations are making provision for instalation of plumbing & electrical elements within and through the floor.

SUMMARY OF INVENTION

A preassembled lightweight floor panel comprising a sub-assembly of steel trusses separated by blocks of insulation, with the edges of the insulation blocks beveled in such a manner as to expose the top and bottom chords of the trusses, the first cementitious membrane cast on the lower face by forcibly immersing this sub-assembly in a thin layer of cementitious fluid until the bottom chord of the steel trusses is encased, the upper cementitious membrane cast over these floor panels after all of the surrounding structural elements are installed, providing the panel with a finished level floor surface and permanently attaching this floor panel to the walls above and below the floor. These specific floor panels are used above grade on dwarf walls, piers, on floors over basements, on upper floors between floors and on flat roofs. Preferably the floor panels are preassembled and cast in a factory environment.

DETAILED DESCRIPTION OF DRAWINGS

Figure 1:
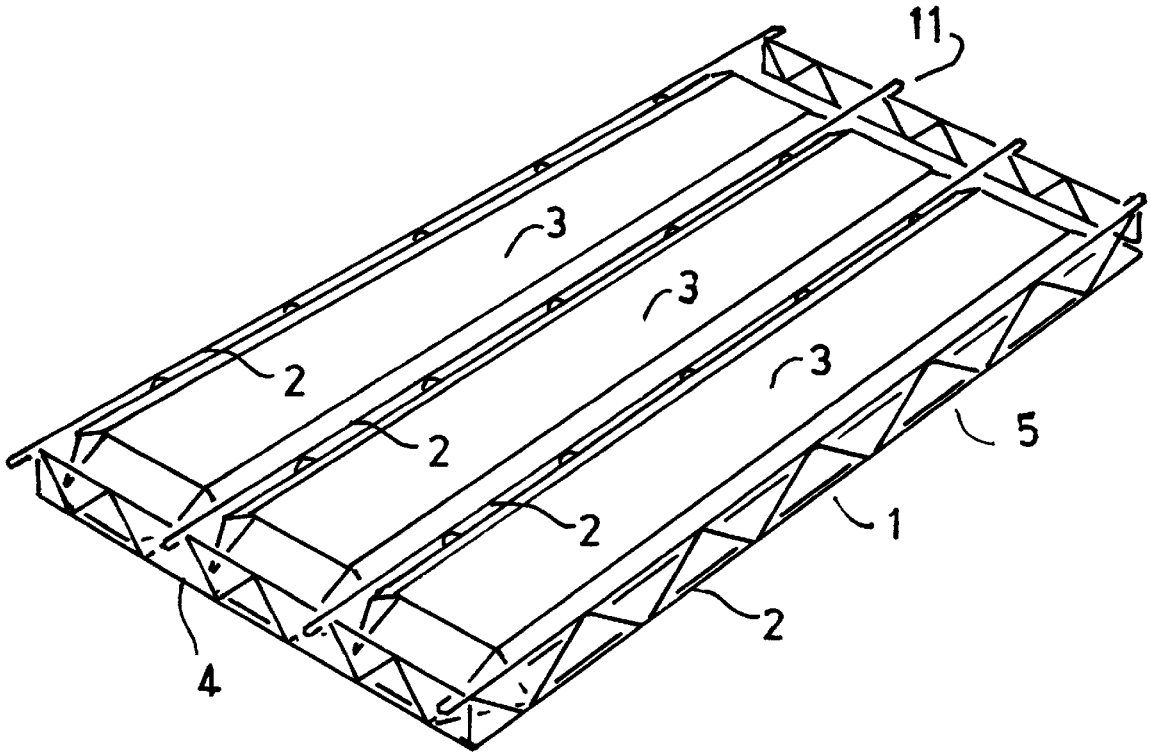
FIG. 1 is an isometric view of a floor panel

FIG. 1 is an isometric view of the upper face of a floor panel (1) showing small parallel trusses (2) between blocks of expanded polystyrene (3) with beveled edges (6) end trusses (4), a cementitious membrane (5) cast on the lower face. The ends of trusses (2) are terminated with a connection (11).

Figure 2:
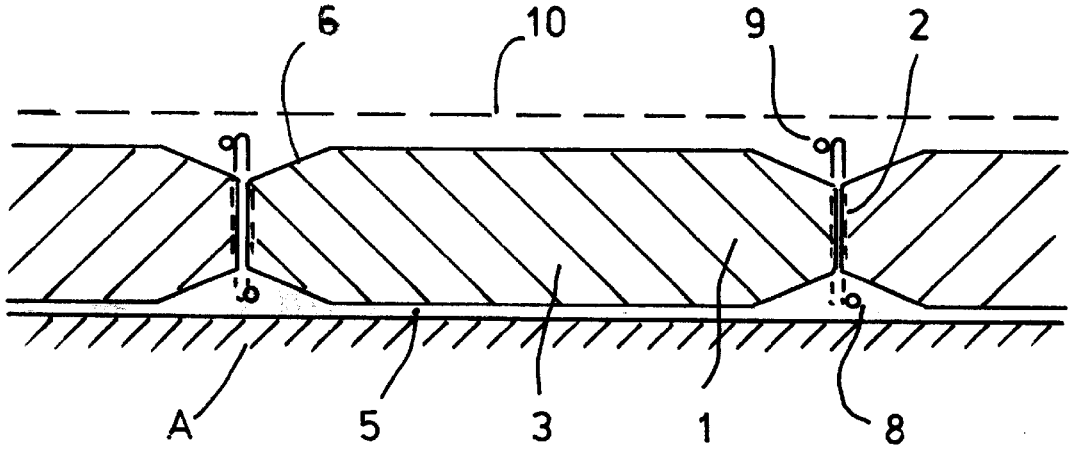
FIG. 2 is a typical cross section through a floor panel

FIG. 2 is a typical vertical and transverse section through portion of a floor panel (1) showing the tapered edges (6) of the expanded polystyrene blocks (3), the parallel trusses (2), the lower membrane (5) on a casting bed 'A', the lower truss chords (8), the upper truss chords (9) and the location of the self leveling cement floor (10).

Figure 3:
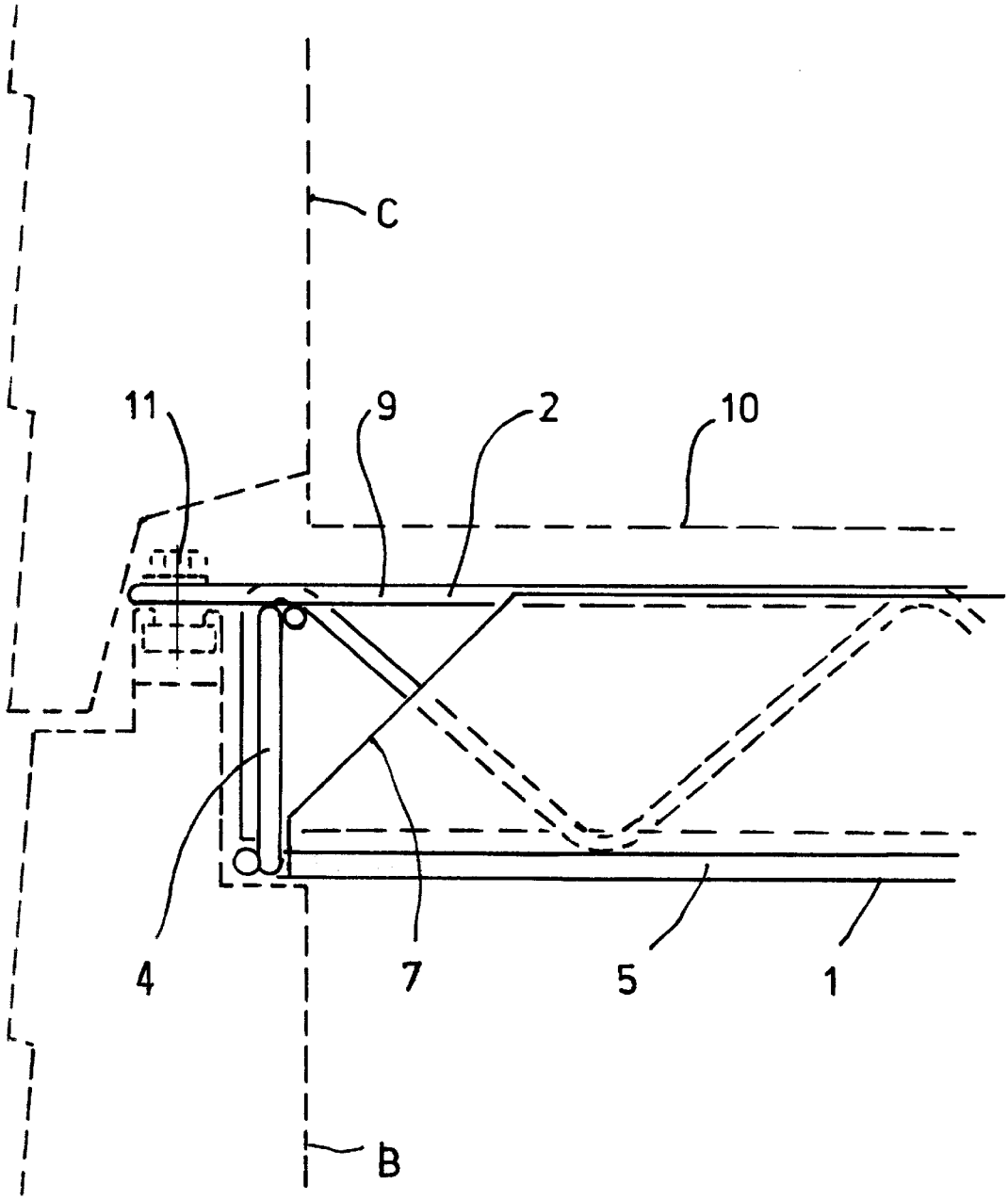
FIG. 3 is an section of a floor panel at a wall

FIG. 3 is a typical vertical section through that end portion of a floor panel (1) supported on structure 'B' and under a wall element 'C' showing the tapered ends (7) on expanded polystyrene blocks (3), the exposed ends of the parallel trusses (2), the end trusses (4) and the lower skin (5). Also shown is the typical profile of the self leveling floor cement (10) and the manner in which the top chord (9) is terminated (11) and connected to wall element 'B'.

Figure 4:
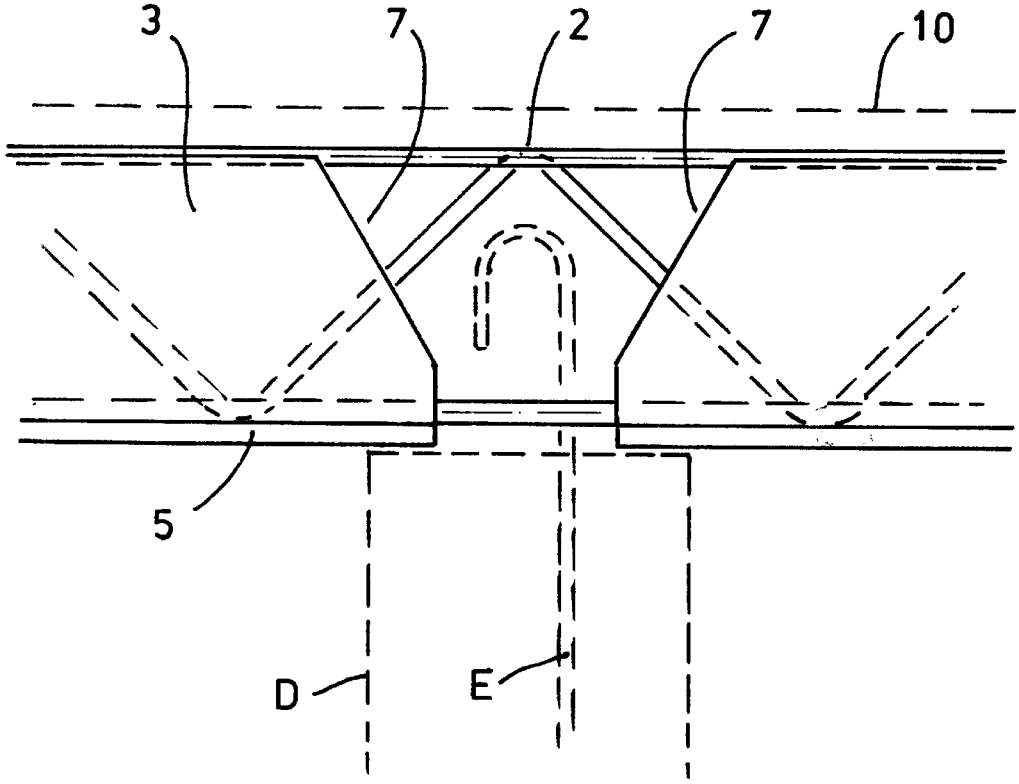
FIG. 4 is a cross section at a interior pier

FIG. 4 is a typical cross section through a floor panel (1) at an intermediate support 'D', such as a pier or internal supporting wall, showing the tapered ends (7) on expanded polystyrene blocks (3) and the exposed parallel trusses (2), and the cut away lower skin (5), making provision for connecting device 'E'. Also shown is the typical profile of the self leveling floor cement (10) used to fill the cavities created by the beveled edges on the expanded polystyrene blocks (3).

Figure 5:
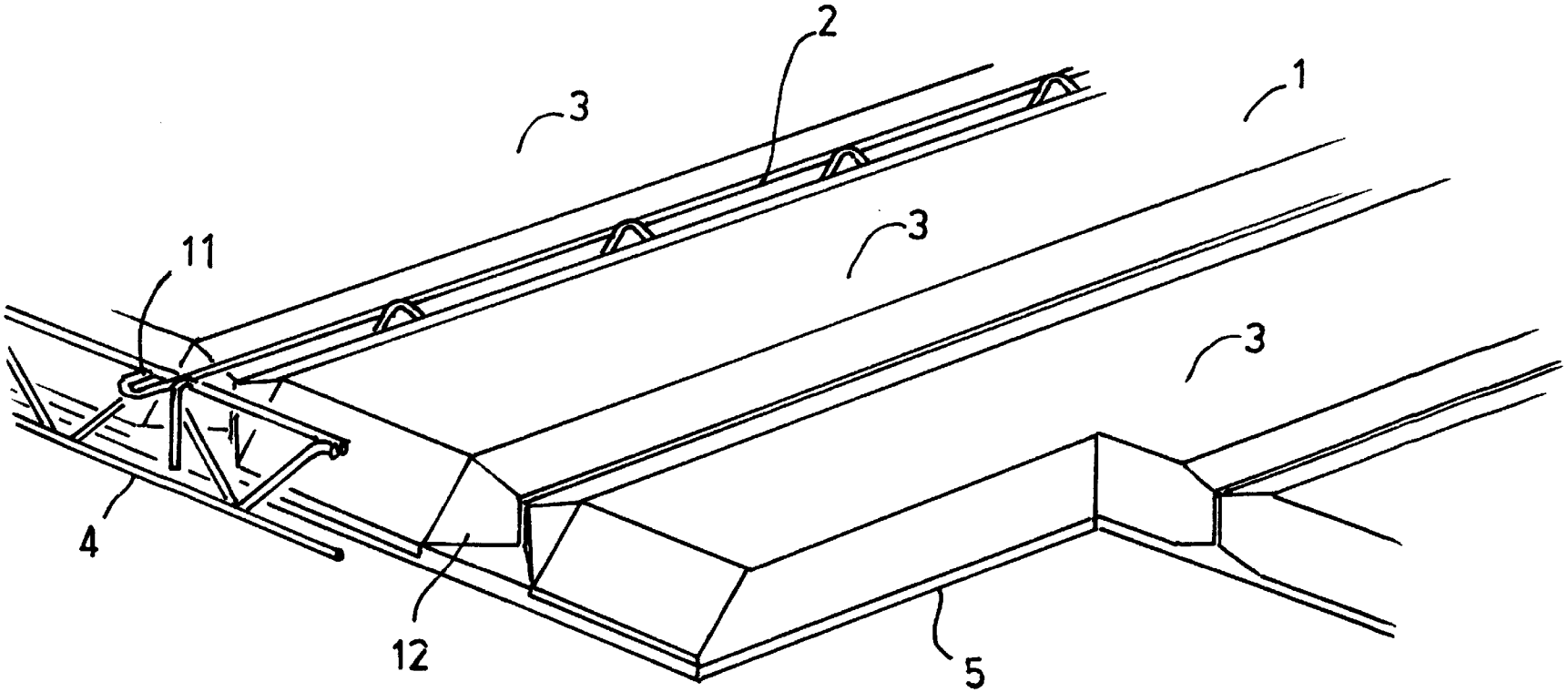
FIG. 5 is a progressively cut away sketch showing floor panel end details

FIG. 5 is a cut a way isometric view of the end of a floor panel (1) showing the end details on the blocks of expanded polystyrene (3), with and without the parallel trusses (2), the end truss (4) truss connection (11) and the lower skin (5), and beveled corners (12) on expanded polystyrene blocks (3).

DETAILED DESCRIPTION OF THIS INVENTION

The preferred embodiment of the invention is illustrated in the attached drawings which are referred to herein. The same reference numerals will be used to identify identical elements throughout the drawings. The actual size of a typical floor panel is 96" wide and 24 to 30 feet long and a minimum of five (5") inches thick. The panel width is only limited to the common highway width restrictions and lengths greater than 30 feet require aditional depth than five (5") inches. In order to show the specific details, all of the illustrations show only portions of a typical floor panel.

FIG. 1 is an isometric view on the upper face of a floor panel (1) as supplied to the building site, before the floor panel (1) is installed and before a self leveling surface has been applied to this upper face. This incomplete floor panel consists of a longitudinal sub-assembly of blocks of expanded polystyrene (3) separated by small steel trusses (2) with a cementitious membrane (5) cast on the lower face. The ends of trusses (2) are terminated with a connection (11) to facilitate permanent attachment the panel (1) to a wall. End trusses (4) provide temporary lateral transverse stiffness to panel (1). The trusses are constructed out of small diameter deformed steel chords, electrically welded to interconnecting small diameter steel diagonal bracing members. The beveled edges (6) of these blocks of expanded polystyrene (3) are shaped in such a manner to control the flow of cementitious fluid around the chords of these trusses.

FIG. 2 is a typical transverse section through portion of a floor panel (1) showing the parallel trusses (2) and the profile of the expanded polystyrene blocks (3). The beveled edges (6) of these blocks of expanded polystyrene (3) shaped in such a manner that when this sub-assembly of said blocks and trusses is immersed in a bed of cementitious fluid on a casting bed 'A', until the lower truss chords (8) are fully encased, creating the lower membrane (5). The upper chords (9) of the parallel trusses (2) are initially exposed and subsequently encased in self leveling floor cement (10). Trusses (2) and blocks of expanded polystyrene (3) are similar in depth.

FIG. 3 is a typical vertical section through that portion of a floor panel (1) supported on and connected to structure 'B' and to a wall element 'C' showing the tapered ends (7) on expanded polystyrene blocks (3), the exposed ends of the parallel trusses (2), the end truss (4) and the termination of the lower membrane (5). Also shown is the typical profile of the self leveling floor cement (10) subsequently used to encase these temporarily exposed elements. The ends of trusses (2) are terminated with a connection (11) to facilitate anchoring the panel (1) to the structure 'B'.

FIG. 4 illustrates the manner in which the floor panel (1) is modified locally directly over an intermediate support 'D' such as a pier or internal supporting wall, showing the tapered ends (7) on expanded polystyrene blocks (3) and the exposed parallel trusses (2), and the cut away lower membrane (5), making provision for connecting devices 'E'. Also shown is the typical profile of the self leveling floor cement (10) used to fill the cavities created by the beveled edges on the expanded polystyrene blocks (3) and permanently anchor the floor panel (1) to the structure 'D'.

FIG. 5 is a cut away isometric view of the upper face of a floor panel (1) in which only one small parallel truss (2) is shown sandwiched between blocks of expanded polystyrene (3), and more clearly illustrates the manner in which the corners (12) of blocks of polystyrene (3) are formed in order to create additional voids at the ends of the small parallel trusses (2), so that additional self leveling floor cement can subsequently anchor the ends of these trusses. Also shown is how the end of truss (2) is terminated with a connection (11) and surround end truss (4) to facilitate anchoring of panel (1) and the lower skin (5) cast on the underside of this panel (1)

The present invention retains all of the primary elements found in each of the fore mentioned existing types of floor construction, and some of the materials used are similar, however the methods of designing, manufacturing and installing these floor panels is vastly different.

The present invention is specifically developed as a of simplifying floor construction for residential housing, including single family houses, multi-family housing and residential structures less than five (5) floors in height.

The present invention retains the desirable qualities of concrete without the excessive weight of concrete. The weight of this floor panel as manufactured and supplied to site is only 6 to 8 PSF. This is between 80 & 90% lighter than other precast floor panels, thus making these panels easy to handle, transport and install. The finished weight of this floor panel is less than 20 PSF and similar in weight to a framed floor.

The present invention is specifically intended for use with similarly manufactured wall panels as outlined U.S. Pat. No. 5,697,189 granted to John and Andrew Miller on Dec. 16, 1997 and applications for subsequent improvements to that patent.

The present invention is designed as a floor panel suitable for mass production in a manufacturing facility where these one piece floor panels are assembled efficiently in a cost and quality controlled environment.

The present invention is designed as a floor panel with the desirable components that provide strength, durability, impervious to termites, decay and resists natural elements such as rain, wind, earthquake and flood and is insulated.

The present invention is designed as a one piece unit and as such eliminates all of the loose components and the many fasteners such as nails, screws, brackets, and hold down brackets needed to assemble a framed floor to each other and to the remainder of the structure.

The present invention is designed to accommodate a variety of superimposed floor loads and floor spans. Both the depth of the trusses and the truss member sizes can be increased to suit the desired stress levels.

The present invention includes a cast membrane on the underside of the floor panel that replaces drywall. This skin is one of the vital components has a variety of functions including that of a suitable architectural appearance on the underside of the ceiling.

Another function of this membrane is providing a rigid diaphragm that controls the shape of the floor panel until it is installed.

Another function of this membrane is encasing the lower chord and portion of the bracing between chords of the small lateral trusses and thus providing limited lateral stability to the upper chord of these trusses. Without this vital function the upper chords of these trusses could fold sideways under load and allow the floor panel to collapse.

Another function of this membrane is providing temporary support to the polystyrene blocks so that a worker may walk directly on the face of the floor panel before the permanent floor skin is applied.

Another function of this membrane is being able to provide this floor panel with the desired fire rating by selecting the type and thickness of a suitable castable cementitious material.

The present invention includes blocks of insulation with numerous functions including controlling the shape and thickness and flow of the cementitious material around the faces of these blocks of insulation and around the steel trusses on both faces of the floor panel.

The present invention includes a preassembled floor panel that is rain proof and capable of temporary outside storage, unlike drywall ceilings material that is incapable of resisting rain without disintegrating.

The present invention includes the on-site multi-purpose use of self leveling cement. These vital functions include converting these incomplete floor panels into a permanent structural panel with cementitious upper membrane on the upper face of the panels.

Another function of this upper membrane of self leveling cement is providing the primary method of interlocking the finished floor to the surrounding structure below and above this floor. The application of self leveling cement in the cavities at the perimeter of these panels and over the intermediate supports converts these areas into permanent connections Another function of this upper membrane of self leveling cement is that of encasing the upper chords of the small longitudinal trusses and converting this upper skin in this localized area along these small trusses into a primary structural elements. The upper now fully encased portion provides the floor panel with sufficient area and capacity to resist the full mid-span compressive design loads on the floor panel.

Another function of this upper membrane of self leveling cement is that of permanently encasing the ends of the small longitudinal trusses in this cement.

Another function of this upper membrane of self leveling cement is that of structural element that spans laterally between the parallel trusses.

Another function of this upper membrane of self leveling cement is that of providing a suitable level floor surface over the entire floor including the upper surface floor joints between the floor panels.

Another function of this self leveling cement is that it is a means of obtaining a level floor surface suitable for the application of ceramic or vinyl flooring Another function of this self leveling cement is that it is a means of creating a non level surface with drainage to specific locations, such as doorways or floor drains.

Conclusions, Ramifications, and Scope of the Invention

Thus the reader will see that this floor panel is a manufactured product and suitable for the mass production of houses, and consists of a sub-assembly of shaped blocks of insulation separated by steel trusses with only upper and lower chords of these trusses exposed, with a ceiling cast on the underside of this sub-assembly. Then these panels are assembled on site and integrated into the main structure with a multi-purpose self leveling floor cement. While the above descriptions contains many specific details, these should not be construed as limitations on the scope of the invention, but rather as one preferred embodiment thereof.

What is claimed is:

1. A manufactured floor panel having a length and width and upper and lower face, said floor panel having at least two blocks void forming insulation material with partially exposed structural elements sandwiched between said blocks, each of said blocks and said structural elements extending through substantially the entire length of said floor panel, wherein the ends of said structural elements are adapted to facilitate the joining of said panel to the adjacent structure, wherein said exposed structural elements on the said lower face of said panel are encased within a thin cementitious ceiling material extending through substantially the entire lower face of said floor panel, wherein said exposed structural elements on the said upper face of said panel are left exposed wherein said floor panel is erected in its final location and said exposed structural elements are attached to the surrounding walls and encased within a cast cementitious floor surface.

2. The floor panel of claim 1 wherein said structural elements between said blocks of insulation consist of continuous elements on each face of the floor panel connected together intermittently to create a structural element.

3. The floor panel of claim 1 wherein said structural elements between said blocks of insulation consists of one or more small diameter deformed steel chords, electrically welded to interconnecting small diameter steel diagonal bracing members.

4. The floor panel of claim 1 wherein at least one of said exposed structural elements between said blocks of insulation is locally encased in a cementitious material to provide lateral restraint to said exposed structural elements.

5. The floor panel of claim 1 wherein said thin cementitious ceiling extending through substantially the entire underside of said floor panel is cast on a bed containing the desired surface texture.

6. The floor panel of claim 1 wherein the longitudinal edges of said blocks of insulation are beveled to expose said structural elements in such a manner as to allow the cast cementitious floor surface to encase the said structural elements on the upper face of said floor panel.

7. The floor panel of claim 1 wherein the ends of said blocks of insulation are beveled to expose the end said structural elements in such a manner as to allow the cast cementitious floor surface to encase all of said structural elements at the end of said floor panel.

8. The floor panel of claim 1 wherein the corners of said blocks of insulation are beveled to expose the ends of said structural elements in such a manner as to allow the cast cementitious floor surface to encase the ends of said structural elements.

9. The floor panel of claim 1 wherein the ends of said structural elements between said blocks of insulation are attached to a transverse truss to temporarily provide transverse stiffness to said floor panel until said panel is erected.

10. The floor panel of claim 1 wherein ends of said floor panels are attached to the surrounding walls and encased together within the cementitious floor surface to interlock the entire structure together.

11. The floor panel of claim 1, wherein the blocks of insulation are expanded polystyrene.

* * * * *